US008368612B2

(12) United States Patent
Eom et al.

(10) Patent No.: US 8,368,612 B2
(45) Date of Patent: Feb. 5, 2013

(54) EMBEDDED ANTENNA APPARATUS

(75) Inventors: Sang Jin Eom, Incheon (KR); Austin Kim, Seongnam-si (KR); Young Eil Kim, Suwon-si (KR); Jun Seok Yang, Seoul (KR)

(73) Assignee: Samsung Electronics Co., Ltd (KR)

( * ) Notice: Subject to any disclaimer, the term of this patent is extended or adjusted under 35 U.S.C. 154(b) by 364 days.

(21) Appl. No.: 12/765,392

(22) Filed: Apr. 22, 2010

(65) Prior Publication Data

US 2010/0271282 A1 Oct. 28, 2010

(30) Foreign Application Priority Data

Apr. 22, 2009 (KR) ..... 10-2009-0035085

(51) Int. Cl.
*H01Q 1/40* (2006.01)

(52) U.S. Cl. ..... 343/873

(58) Field of Classification Search ..... 343/873, 343/702, 700 MS

See application file for complete search history.

(56) References Cited

U.S. PATENT DOCUMENTS

| | | | | |
|---|---|---|---|---|
| 2003/0174092 | A1* | 9/2003 | Sullivan et al. | 343/702 |
| 2008/0079642 | A1* | 4/2008 | Ishizuka et al. | 343/702 |
| 2008/0129612 | A1* | 6/2008 | Wang et al. | 343/702 |
| 2009/0002243 | A1* | 1/2009 | Dahlstrom et al. | 343/702 |
| 2009/0262028 | A1* | 10/2009 | Mumbru et al. | 343/702 |
| 2009/0275370 | A1* | 11/2009 | Schlub et al. | 455/575.7 |
| 2009/0303140 | A1* | 12/2009 | Sato et al. | 343/702 |
| 2011/0273343 | A1* | 11/2011 | Qi et al. | 343/702 |

* cited by examiner

*Primary Examiner* — Huedung Mancuso
(74) *Attorney, Agent, or Firm* — The Farrell Law Firm, P.C.

(57) ABSTRACT

An embedded antenna apparatus of a communication terminal is provided. The antenna apparatus includes a plate board having a feeding pad disposed on a side of the board; a device carrier mounted on a side of the board to expose the feeding pad; a radiation device including at least two radiation lines extending from the feeding pad to a surface of the device carrier along different paths, the at least two radiation lines radiating at a preset frequency band when electric power is fed through the feeding pad; and a ground plate having a flat plate shape mounted in an edge of the side of the board and disposed perpendicular to the side of the board, and contacting one end each of the at least two radiation lines to ground the radiation device.

10 Claims, 11 Drawing Sheets

EMBEDDED ANTENNA APPARATUS

PRIORITY

This application claims priority under 35 U.S.C. §119(a) to an application filed in the Korean Intellectual Property Office on Apr. 22, 2009, and assigned Serial No. 10-2009-0035085, the content of which is incorporated herein by reference.

BACKGROUND OF THE INVENTION

1. Field of the Invention

The present invention relates generally to an antenna apparatus and, more particularly, to an embedded antenna apparatus of a communication terminal.

2. Description of the Related Art

Wireless communication systems generally provide various kinds of multimedia services, such as Global Positioning System (GPS) services, BLUETOOTH® communication services, Internet services, etc. In order for the wireless communication system to effectively provide multimedia service without failure, a large amount of data must be transmitted at a guaranteed high transmission rate. In order to provide a guaranteed high transmission rate, various studies and research projects for improving performance of an antenna apparatus of a communication terminal are being conducted, since an antenna apparatus substantially controls transmission and reception of data for multimedia services.

Many communication terminals are lightweight, and have relatively small dimensions, in order to improve portability. When some antenna apparatuses such as road antennae or helical antennae protrude from communication terminals, the communication terminal is not carried as easily, and the antenna apparatus may be easily damaged. Therefore, antenna apparatuses have recently been implemented in the form of an embedded antenna apparatus that is mounted inside a communication terminal. Such embedded antenna apparatuses may radiate at a preset frequency band.

Conventional embedded antenna apparatuses radiate at a relatively narrow frequency band. A mobile communication terminal including only a single embedded antenna cannot use many various multimedia services provided through wireless communications systems. Due to this limitation, a communication terminal may have a plurality of antenna devices in order to use a relatively extended frequency band. However, it is difficult to produce a small communication terminal that includes multiple embedded antenna devices.

SUMMARY OF THE INVENTION

The present invention has been made to address at least the above problems and/or disadvantages, and to provide at least the advantages described below. Accordingly, the present invention provides an embedded antenna apparatus of a communication terminal.

In accordance with one aspect of the present invention, an embedded antenna apparatus is provided. The embedded antenna apparatus includes a plate board having a feeding pad disposed on a side of the board; a radiation device including at least two radiation lines formed on the side of the board, the two radiation lines respectively extending from the feeding pad and radiating at a preset frequency band when electric power is fed through the feeding pad; and a ground plate mounted on a side of the board and contacting one end of each of the radiation lines to ground the radiation device.

In accordance with another aspect of the present invention, an embedded antenna apparatus of a communication terminal is provided. The embedded antenna apparatus includes a plate board having a feeding pad disposed on a side of the board; a device carrier mounted on a side of the board to expose the feeding pad; a radiation device including at least two radiation lines extending from the feeding pad to a surface of the device carrier along different paths, the at least two radiation lines radiating at a preset frequency band when electric power is fed through the feeding pad; and a ground plate having a flat plate shape mounted in an edge of the side of the board and disposed perpendicular to the side of the board, and contacting one end each of the at least two radiation lines to ground the radiation device.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The objects, features and advantages of the present invention will be more apparent from the following detailed description in conjunction with the accompanying drawings, in which.

DETAILED DESCRIPTION OF EMBODIMENTS OF THE PRESENT INVENTION

Hereinafter, embodiments of the present invention are described in detail with reference to the accompanying drawings. The same reference symbols are used throughout the drawings to refer to the same or like parts. Detailed descriptions of well-known functions and structures incorporated herein may be omitted to avoid obscuring the subject matter of the present invention. Definitions of specific terms or words used in the specification and the claims should be construed in accordance with the spirit of the invention.

Figure 1:
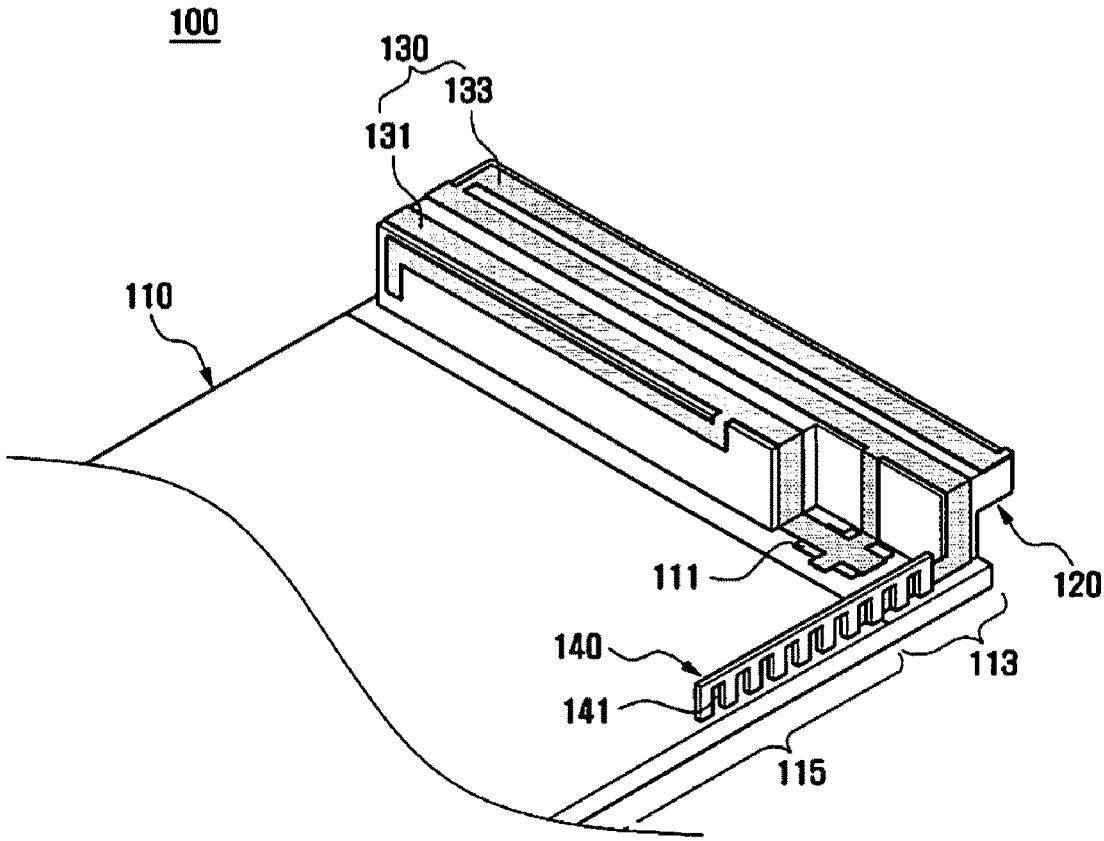
FIG. 1 is a perspective diagram illustrating an antenna apparatus according to an embodiment of the present invention.
Figure 2:
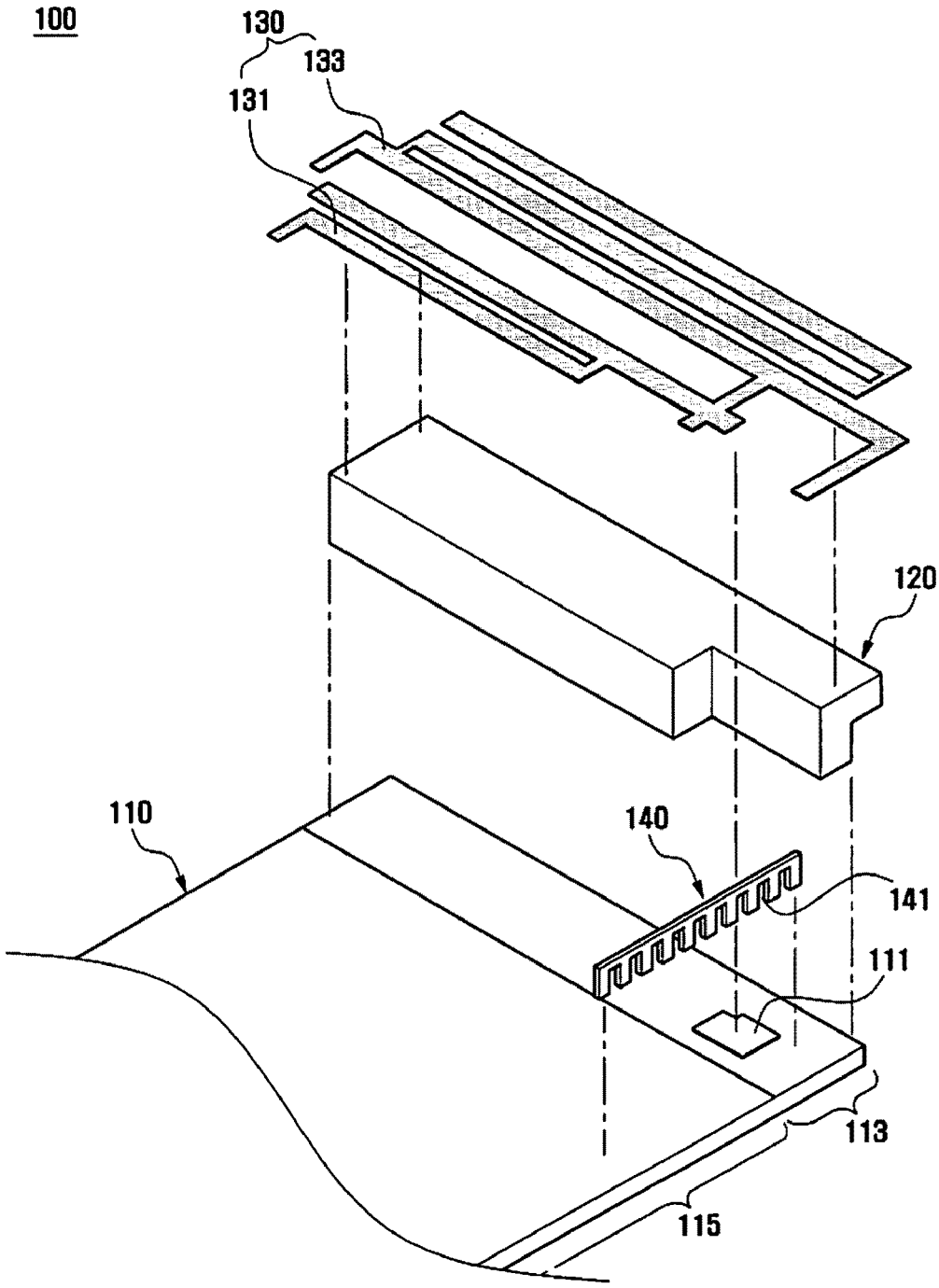
FIG. 2 is diagram illustrating an exploded perspective view of the antenna apparatus FIG. 1.

FIG. 1 is a perspective view illustrating an antenna apparatus according to an embodiment of the present invention and FIG. 2 is an exploded perspective view of the antenna apparatus FIG. 1. The antenna apparatus of FIG. 1 may be used as an embedded antenna apparatus.

Referring to FIGS. 1 and 2, an antenna apparatus 100 according to an embodiment of the present invention includes a board 110, a device carrier 120, a radiation device 130, and a ground plate 140.

The board 110 feeds electric power to supports the antenna apparatus 100. The board 110 has a flat plate with at least four corners. The board 110 may be a Printed Circuit Board (PCB). More specifically, the board 110 is made of a dielectric substance having power-feeding lines. For example, the board 110 may be a dielectric having conductivity $\sigma$ of 0.002. In this case, the power-feeding lines may have a via, and are connected to a power source through an end thereof.

The board 110 includes a feeding pad 111 disposed at a side thereof. The feeding pad 111 is connected to the power-feeding lines. More specifically, electric power is fed from the power source to the feeding pad 111 through the power-feeding lines. One side of the board 110 may be divided into an antenna region 113 and a body region 115. The feeding pad 111 is formed in the antenna region 113. Although not depicted, various electronic functional groups may be mounted in the body region 115 separately from the antenna apparatus 100.

The device carrier 120 is provided to separate components of the antenna apparatus 100. The device carrier 120 has a plate structure having a preset thickness, and is made of a dielectric substance. The device carrier 120 may be made of a dielectric similar to or different from a dielectric of the board 110, including a dielectric having a relative high loss ratio. For example, the device carrier 120 may be made of a dielectric having conductivity of 0.02 and permittivity $\in$ of 4.6. The device carrier 120 is mounted in the antenna region 113 of the board 110. In this case, the device carrier 120 may have a shape for mounting various parts of the antenna apparatus 100 in the antenna region 113, excluding for the feeding pad 111. The device carrier 120 may have a shape that corresponds to the antenna region 113 and protrudes parallel to the antenna region 113.

The radiation device 130 transmits and receives electromagnetic waves in the antenna apparatus 100, may be made from a metal. The radiation device 130 comes into contact with the feeding pad 111 and is formed on surfaces of the antenna region 113 and the device carrier 120. At least some of the radiation device 130 is separated from a side of the board 110 by the device carrier 120. Electric power is fed through the feeding pad 111 and is applied to the radiation device 130, which radiates at a preset frequency band.

As shown in FIGS. 1 and 2, the radiation device 130 branches out from the feeding pad 111. More specifically, the radiation device 130 includes at least two radiation lines 131 and 133 that come into contact with the feeding pad 111. The radiation lines 131 and 133 extend along the side and an upper side of the device carrier 120, and may extend from the feeding pad 111 to the antenna region 113 via the device carrier 120. The radiation lines 131 and 133 may have at least one bending portion. More specifically, the radiation lines 131 and 133 may be bent at corners of the boundary regions or surfaces of the board 110 and the device carrier 120 to form the bending portion. The radiation lines 131 and 133 may be one of a meander type, a spiral type, a step type, and a loop type.

Due the branch-structure of the radiation device 130, a capacitance of the radiation device 130 is comparatively greater than a capacitance of radiation devices having non-branched structures. The capacitance of the radiation device 130 is determined by an exposed area of the device carrier 120 within the radiation device 130. More specifically, the capacitance is determined by a distance between segment feeding lines extending in the same direction in the respective radiation lines 131 and 133. When the capacitance of the radiation device 130 increases, the radiation device 130 may radiate at a relative high frequency band and a low frequency band. For example, the relative high frequency band may be a communication band according to the Global System for Mobile communications (GSM) and a Code Division Multiple Access (CDMA) scheme. The low frequency band may be a Long Term Evolution (LTE) communication band.

The ground plate 140 grounds the antenna apparatus 100. The ground plate 140 has a flat plate having at least two neighboring corners, and is mounted at an edge of a side of the board 110. More specifically, the ground plate 140 is mounted on the board 110 through the two neighboring corners. The ground plate 140 may be restrictively mounted in the antenna region 113 or over the antenna region 113 and the body region 115. The ground plate 140 is disposed perpendicular to a side of the board 110, such that an area of a side of the ground plate 140 contacting the board 110 is narrower than an area of the opposite side thereof corresponding to the device carrier 120. The ground plate 140 comes into contact with the radiation device 130, and contacts the opposite end of any one of the radiation lines 131 and 133. When the electric power is fed to the radiation device 130, the ground plate 140 grounds the radiation device 130.

The ground plate 140 may have various patterned structures. For example, the ground plate 140 may have a plurality of grooves 141 that may contact a side of the board 110. More specifically, the ground plate 140 may downwardly branch from a side of the board 110 perpendicular to the board 110. A total volume occupied by the ground plate 140 or a volume of an area overlapping the ground plate over the board 110 is reduced, so that the frequency band for the radiation of the radiation device 130 can be adjusted.

Figure 3:
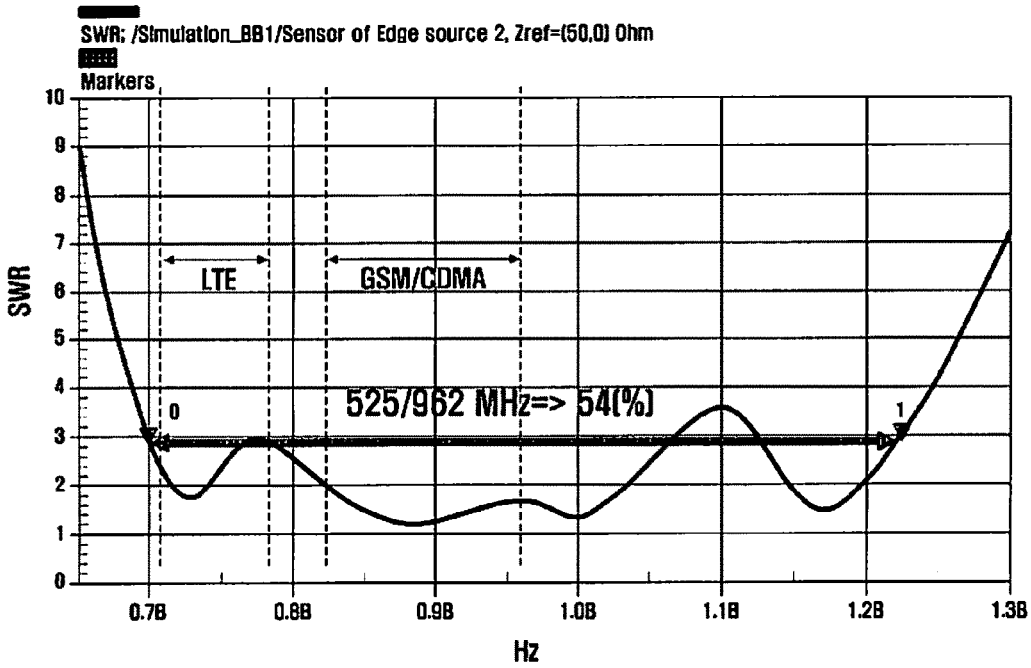
FIG. 3 is a graph illustrating radiation characteristic of the antenna apparatus of FIG. 1.
Figure 4:
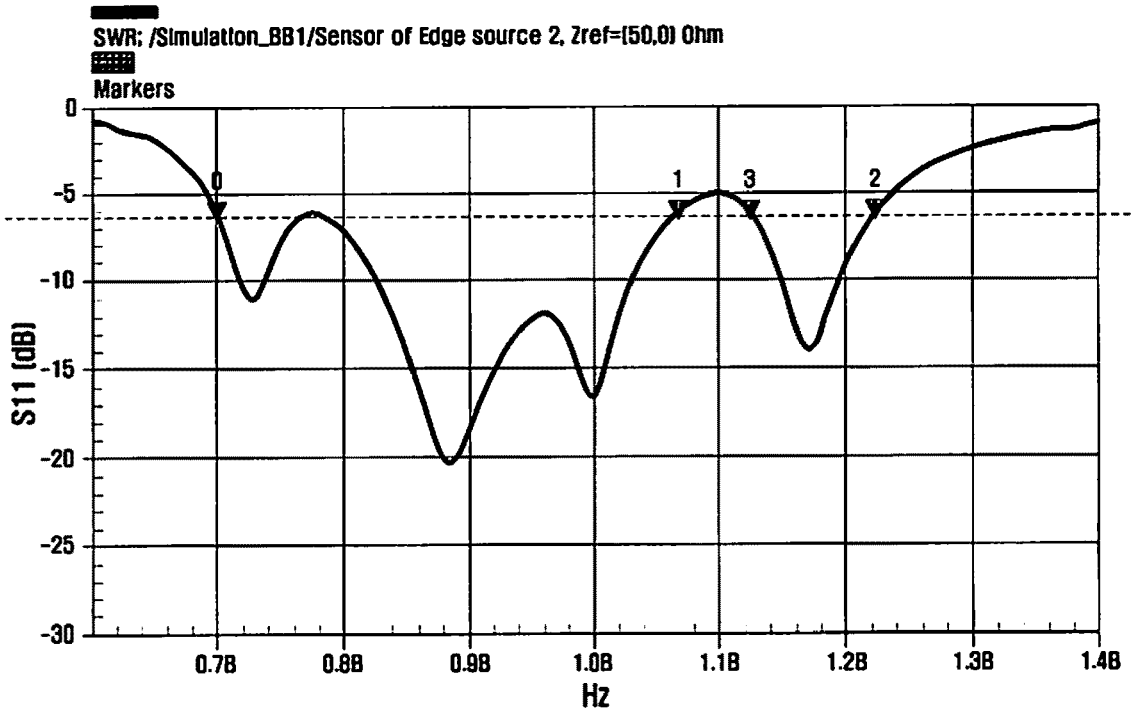
FIG. 4 is a graph illustrating radiation characteristic of the antenna apparatus of FIG. 1.

Radiation characteristics of the antenna apparatus 100 according to an embodiment of the present invention will be described as follows with reference to FIGS. 3 and 4. FIGS. 3 and 4 are graphs illustrating radiation characteristics of the antenna apparatus of FIG. 1.

The antenna apparatus 100, as illustrated in FIGS. 3 and 4, radiates in a Super Wide Band (SWB). When the electric power is fed from the power source through the feeding pad 111, the radiation device 130 radiates at a frequency band corresponding to about 718 MHz to 1,220 MHz. The radiation device 130 radiates at a frequency band having a bandwidth occupying about just over 50% of a bandwidth of a center frequency. In other words, the antenna apparatus 100 may use the LTE communication band corresponding to a frequency band from 704 MHz to 787 MHz, and may further use the GSM and CDMA communication band corresponding to a band from 824 MHz to 960 MHz.

Figure 5:
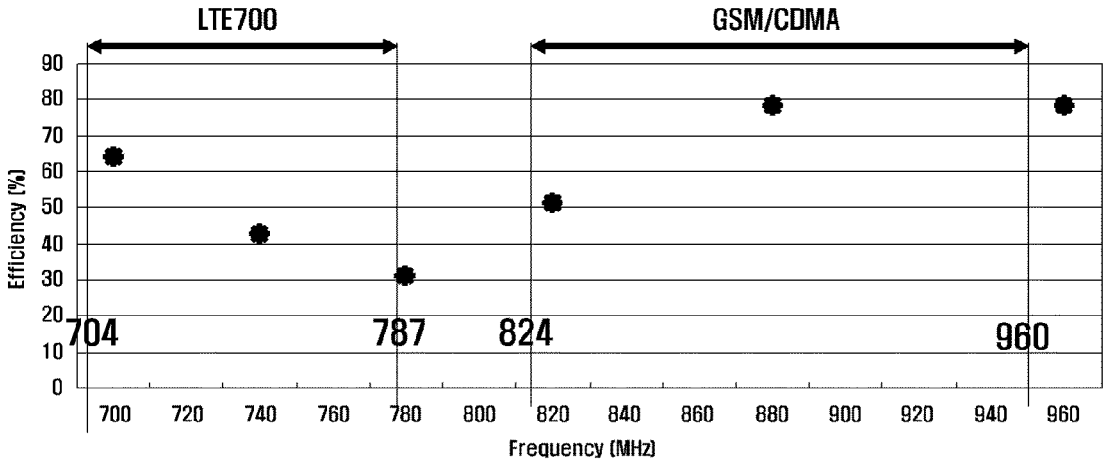
FIG. 5 is a graph illustrating radiation efficiency of the antenna apparatus of FIG. 1.

Radiation efficiency of the antenna apparatus 100 according to an embodiment of the present invention will be described as follows. FIG. 5 is a graph illustrating radiation efficiency of the antenna apparatus of FIG. 1.

The antenna apparatus 100 according to an embodiment of the present invention, as illustrated in FIG. 5, has relatively high radiation efficiency at a wideband. When the electric power is fed through the feeding pad 111, the antenna apparatus 100 radiates with radiation efficiency of about just over 50% at LTE, GSM, and CDMA communication bands. The antenna apparatus 100 has a relatively high gain as well as the radiation efficiency at a peculiar frequency as listed in following Table 1.

TABLE 1

| Frequency (MHz) | Gain (dBi) | Radiation efficiency (%) |
|---|---|---|
| 704 | 0.16 | 63 |
| 750 | −0.17 | 44 |
| 787 | −2.64 | 30 |
| 824 | −0.31 | 52 |
| 890 | 1.40 | 77 |
| 960 | 1.59 | 78 |

Figure 6:
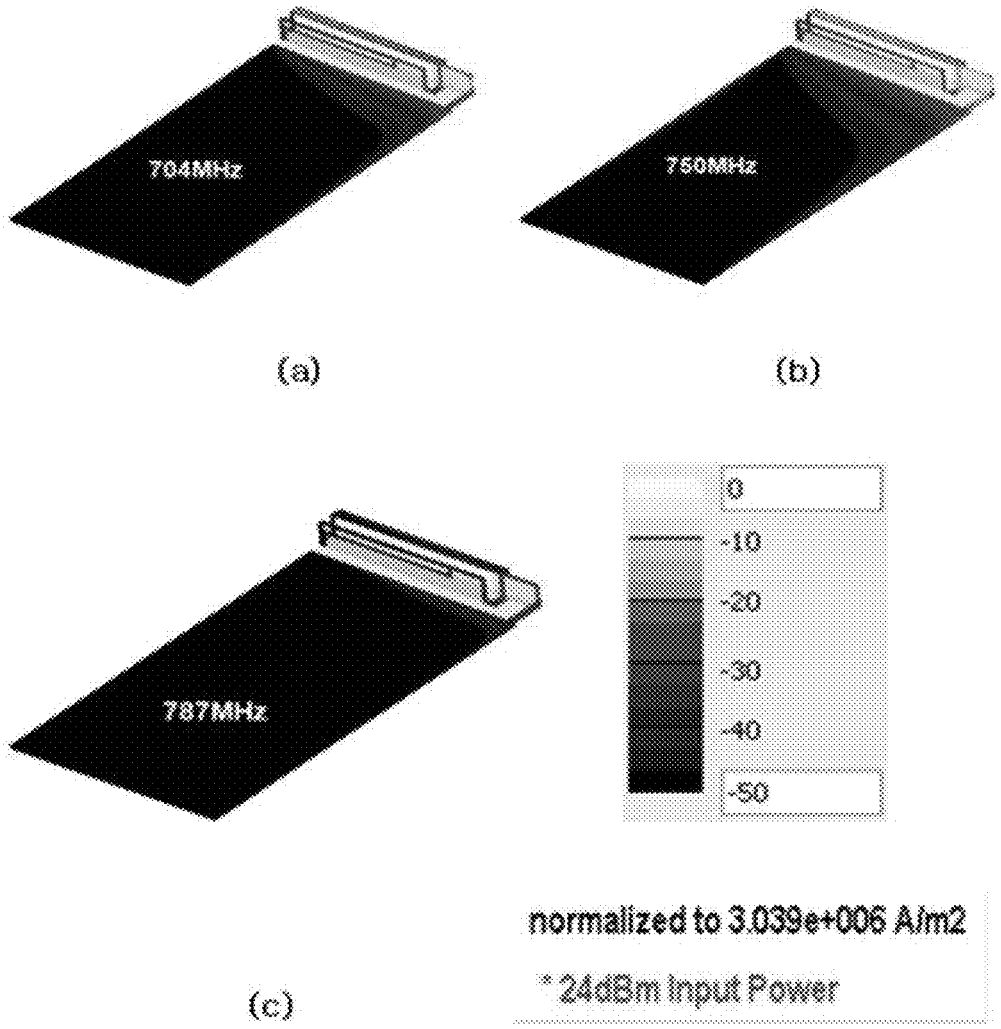
FIG. 6 is a diagram illustrating current distribution when the antenna apparatus of FIG. 1 radiates.
Figure 7:
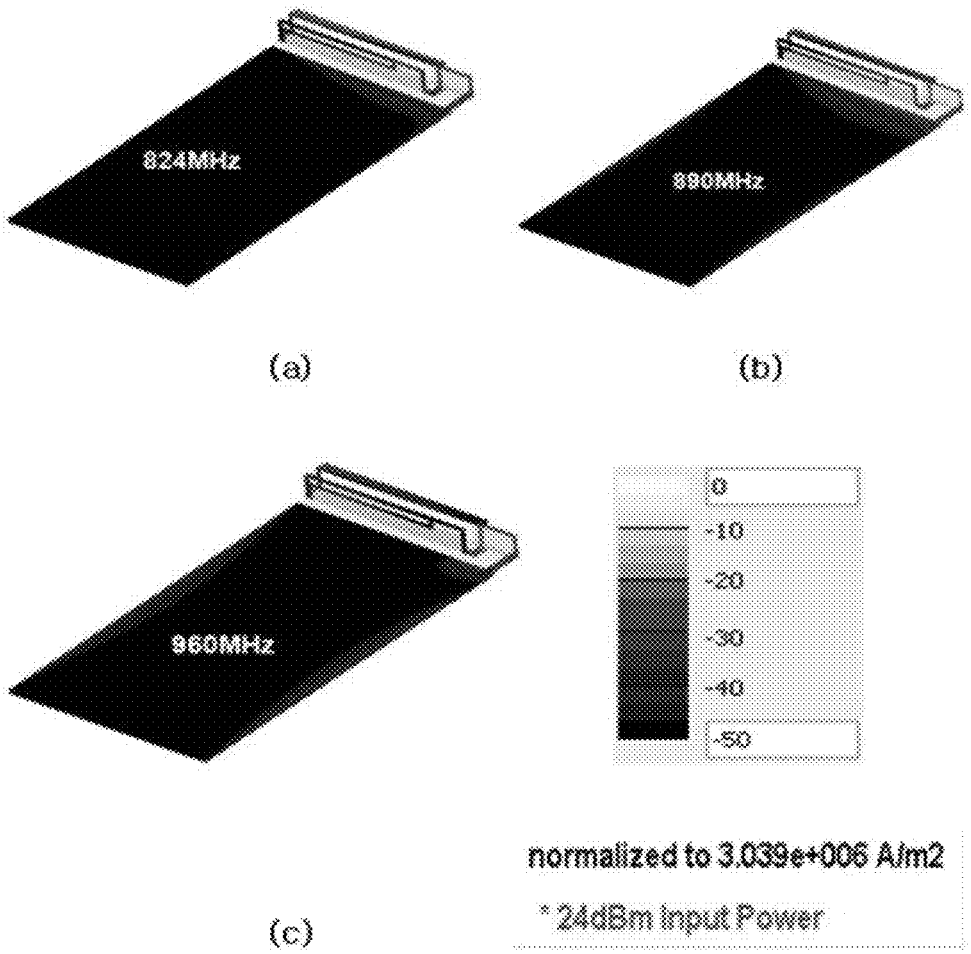
FIG. 7 is a diagram illustrating current distribution when the antenna apparatus of FIG. 1 radiates.

The surface current distribution at the radiation of the antenna apparatus 100 is described as follows with reference to FIGS. 6 and 7. FIGS. 6 and 7 are diagrams illustrating current distribution when the antenna apparatus of FIG. 1 radiates.

When the antenna apparatus 100 radiates at a peculiar frequency such as 750 MHz, 750 MHz, or 787 MHz, such as in the LTE communication band ranging from 704 MHz to 787 MHz, current is distributed at the antenna apparatus 100 as illustrated in FIG. 6. When the antenna apparatus 100 radiates at a peculiar frequency such as 824 MHz, 89 MHz, or 960 MHz, such as in CDMA communication bands ranging from 824 MHz to 960 MHz, current is distributed at the antenna apparatus 100 as illustrated in FIG. 7.

Figure 8:
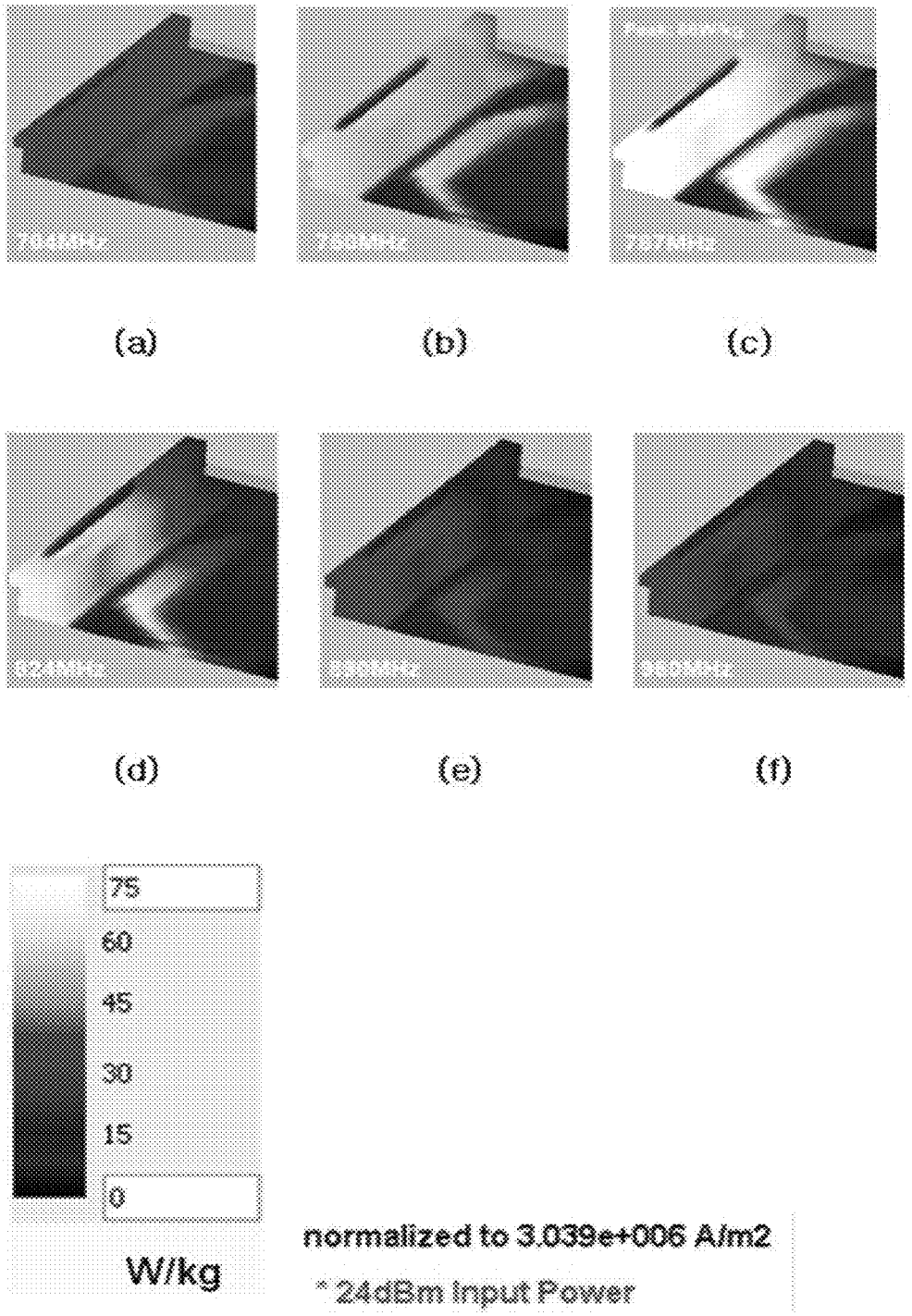
FIG. 8 is a diagram illustrating dielectric absorption when the antenna apparatus of FIG. 1 radiates.

The dielectric absorption of the antenna apparatus 100 is described as follows with reference to FIG. 8. FIG. 8 is a diagram illustrating dielectric absorption when the antenna apparatus of FIG. 1 radiates.

When the antenna apparatus 100 radiates at a peculiar frequency such as 704 MHz, 750 MHz, 787 MHz, 824 MHz, or 960 MHz, the dielectric absorption is carried out in the antenna apparatus 100 as illustrated in FIG. 8. When the electric power is fed to the radiation device 130 through the feeding pad 111, the dielectric absorption is carried out by the device carrier 120 relatively and effectively. This shows that a relatively high loss of efficiency occurs in the device carrier 120, when the apparatus 100 radiates at these peculiar frequencies. Therefore, the antenna apparatus 100 may use a wide bandwidth including the LTE, GSM, and CDMA communication bands through the device carrier 120 more effectively.

Figure 9:
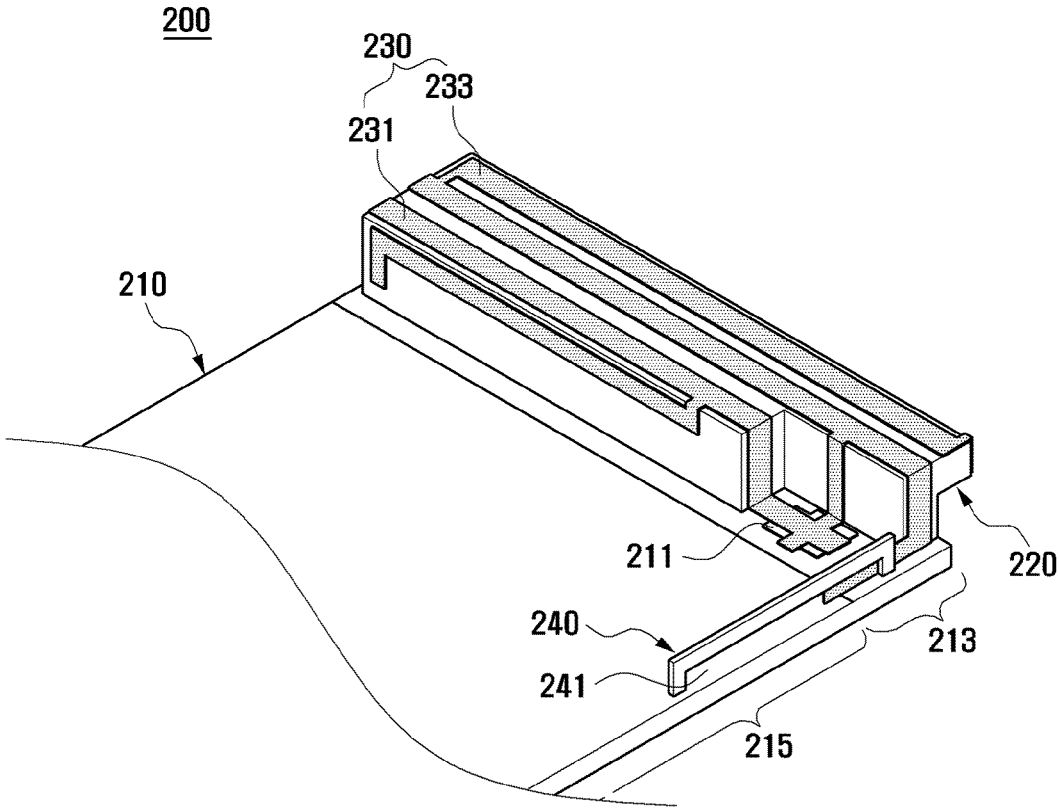
FIG. 9 is a perspective diagram illustrating an antenna apparatus according to another embodiment of the present invention.
Figure 10:
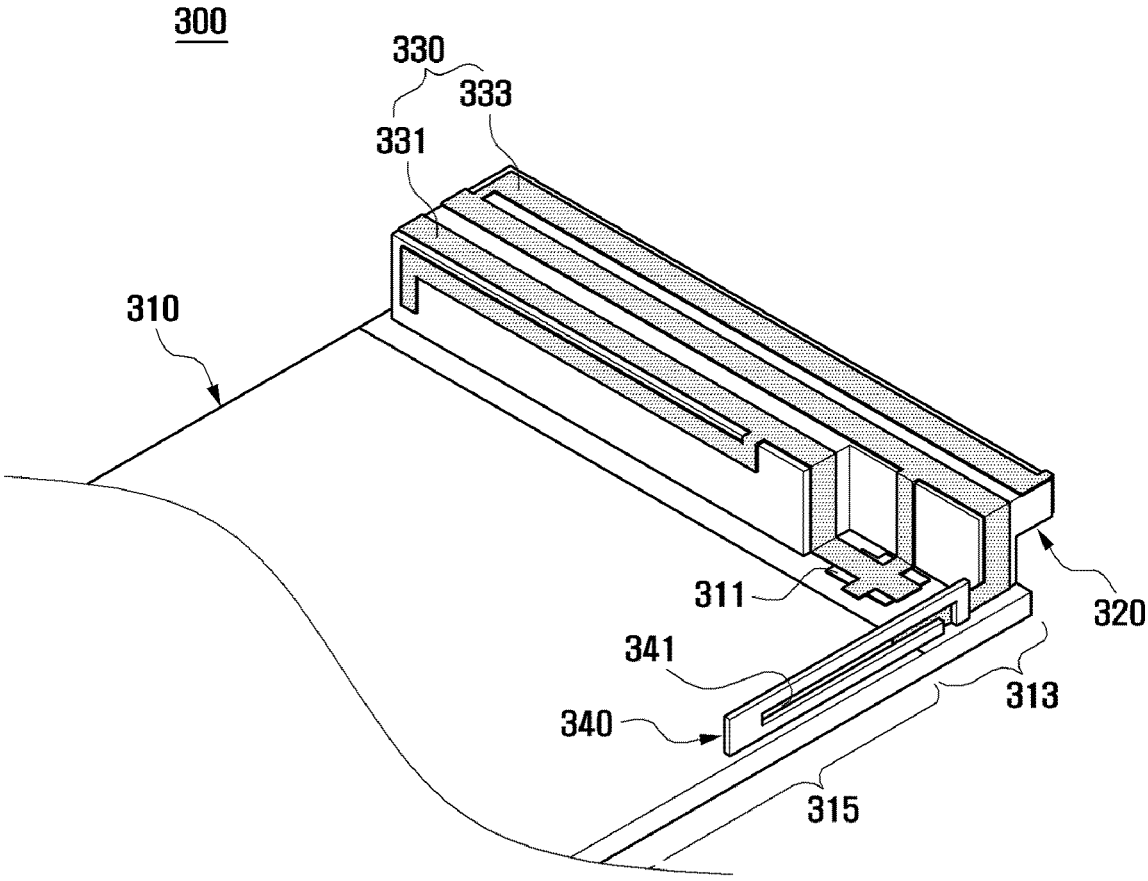
FIG. 10 is a perspective diagram illustrating an antenna apparatus according to still another embodiment of the present invention.

Although the ground plate 140 has a plurality of grooves in the above-described embodiment illustrated in FIGS. 1-2, the present invention is not limited thereto. Ground plates in accordance with embodiments of the present invention may be implemented in various forms. FIGS. 9 and 10 illustrate examples of other such ground plates and antenna apparatuses according to other embodiments of the present invention.

FIG. 9 is a perspective diagram illustrating an antenna apparatus according to another embodiment of the present invention.

Referring to FIG. 9, an antenna apparatus 200 according to another embodiment of the present invention includes a board 210, a device carrier 220, a radiation device 230, and a ground plate 240. In this embodiment, basic configuration of the antenna apparatus 200 is identical to that of the antenna apparatus according to the previously described embodiment of FIGS. 1 and 2, and a description thereof will be omitted.

However, the ground plate 240 may have a single groove 241. In this case, the groove 241 of the ground plate 240 may contact a side of the board 210. In other words, the ground plate 240 may branch downwardly from a side of the board 210 perpendicular to the board 210. A total volume of the ground plate 240 or the volume of an overlapping area of the ground plate 240 over the board 210 is reduced so that the frequency band for the radiation of the radiation device 230 can be adjusted. More specifically, the ground plate 240 may be tuned into various shapes by patterning so that the performance of the antenna apparatus 200 can be minutely adjusted.

Figure 11:
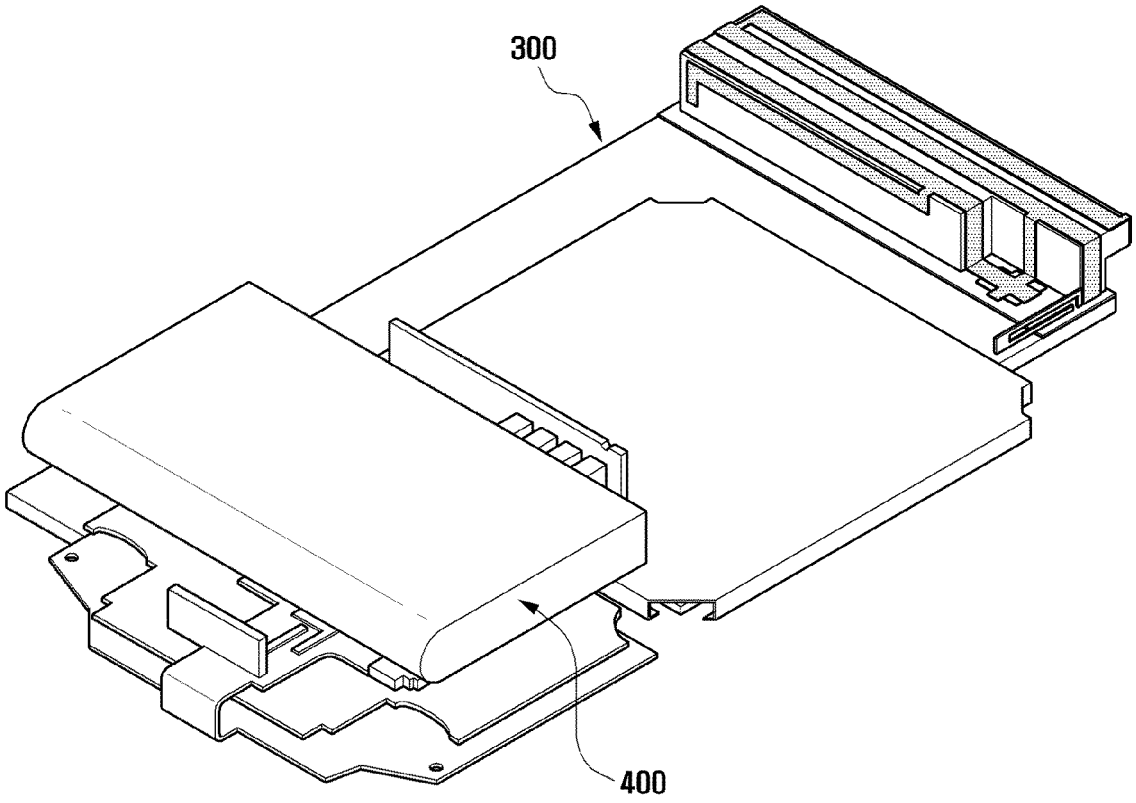
FIG. 11 a perspective view illustrating an example of a communication terminal to which an antenna apparatus according to an embodiment of the present invention is mounted.

FIG. 10 is a perspective diagram illustrating an antenna apparatus according to still another embodiment of the present invention. FIG. 11 a perspective diagram illustrating an example of a communication terminal to which antenna apparatuses according to embodiments of the present invention may be mounted.

Referring to FIG. 10, an antenna apparatus 300 according to another embodiment of the present invention includes a board 310, a device carrier 320, a radiation device 330, and a ground plate 340. A basic configuration of the antenna apparatus 300 is identical to that of previously described embodiments of the present invention, and therefore, a description thereof will be omitted.

However, the ground plate 340 may have at least one hole 341 penetrating the ground plate 340. The hole 341 may be parallel to a side of the board 310. Total volume of the ground plate 340 or the volume of an overlapping area of the ground plate 340 over the board 310 is reduced so that the frequency band for the radiation of the radiation device 330 can be adjusted. In other words, the ground plate 340 may be tuned into various shapes by patterning so that performance of the antenna apparatus 300 can be minutely adjusted. The antenna apparatus 300, as illustrated in FIG. 11, may be coupled with a body 400 of a communication terminal through a body region 315 of the board 310. By doing so, the antenna apparatus 300 is inserted into the communication terminal for the installation.

As described above, in an embedded antenna apparatus of a communication terminal according to embodiments of the present invention, the radiation device is implemented with a branched structure in order to increase the number of frequency bands that can be used the antenna apparatus. More specifically, an antenna apparatus according to embodiments of the present invention can use a relatively high frequency band as well as a relatively low frequency band. For example, an antenna apparatus according to embodiments of the present invention may use the LTE, GSM, and CDMA communication bands. Due to these advantages, a communication terminal according to embodiments of the present invention may use the expanded frequency band through a single antenna apparatus, allowing such a communication terminal to be relatively small. Therefore, a communication terminal according to embodiments of the present invention can use various multimedia services within various wireless communication systems through a single antenna apparatus.

In an embedded antenna apparatus of a communication terminal according to embodiments of the present invention, a ground plate is disposed perpendicular to a side of the board so that a performance of the antenna apparatus can be improved. In other words, the contact area between the ground plate and the board is reduced so that loss generated through the board can be prevented. The ground plate may be patterned in various shapes and is easily tuned so that the performance of the antenna apparatus can be minutely adjusted, which allows the antenna apparatus according to embodiments of the present invention to use the expanded frequency band more effectively.

In an embedded antenna apparatus of a communication terminal according to embodiments of the present invention, a radiation device is mounted on a board through the device carrier, such that a performance of the antenna apparatus can be improved. More specifically, the device carrier is made of dielectric so that a relatively high loss may be generated from the device carrier when the antenna apparatus radiates, which the antenna apparatus according to embodiments of the present invention to use the expanded frequency band more effectively.

Embodiments of the present invention are provided for the easy description and understanding of the present invention with specific examples but do not limit the scope of the present invention. It will be appreciated by those skilled in the art that various changes and modifications may be practiced without departing from the spirit of the present invention.

What is claimed is:

1. An embedded antenna apparatus of a communication terminal comprising:

a plate board having a feeding pad disposed on a side of the board;

a radiation device including at least two radiation lines formed on the side of the board, the two radiation lines respectively extending from the feeding pad and radiating at a preset frequency band when electric power is fed through the feeding pad; and a ground plate mounted on a side of the board and contacting one end of each of the radiation lines to ground the radiation device, wherein the ground plate includes a flat plate mounted in an edge of the side of the board and disposed perpendicular to the side of the board.

2. The embedded antenna apparatus of a communication terminal of claim 1, further comprising a device carrier mounted on the side of the board to expose the feeding pad, and wherein the radiation device is disposed on a surface of the device carrier.

3. The embedded antenna apparatus of a communication terminal of claim 1, wherein the ground plate has at least one groove contacting the side of the board.

4. The embedded antenna apparatus of a communication terminal of claim 1, wherein the ground plate has at least one hole, such that a longest side of the hole is parallel to the side of the board and the hole penetrates the ground plate.

5. The embedded antenna apparatus of a communication terminal of claim 1, wherein the two radiation lines include at least one bending portion, and wherein the two radiation lines comprise at least one of a meander type radiation line, a spiral type radiation line, a step type radiation line, and a loop type radiation line.

6. The embedded antenna apparatus of a communication terminal of claim 1, wherein the frequency band corresponds to Long Term Evolution (LTE), Global System for Mobile communications (GSM), and Code Division Multiple Access (CDMA) communication bands.

7. An embedded antenna apparatus of a communication terminal comprising:

a plate board having a feeding pad disposed on a side of the board;

a device carrier mounted on a side of the board to expose the feeding pad;

a radiation device including at least two radiation lines extending from the feeding pad to a surface of the device carrier along different paths, the at least two radiation lines radiating at a preset frequency band when electric power is fed through the feeding pad; and a ground plate having a flat plate shape mounted in an edge of the side of the board and disposed perpendicular to the side of the board, and contacting one end each of the at least two radiation lines to ground the radiation device.

8. The embedded antenna apparatus of a communication terminal of claim 7, wherein the ground plate has at least one groove contacting the side of the board.

9. The embedded antenna apparatus of a communication terminal of claim 7, wherein the ground plate has at least one hole, such that a longest side of the hole is parallel to the side of the board and the hole penetrates the ground plate.

10. The embedded antenna apparatus of a communication terminal of claim 7, wherein the at least two radiation lines extend from the feeding pad to the side of the board via the device carrier.

* * * * *